US006707393B1

(12) United States Patent
Moore

(10) Patent No.: US 6,707,393 B1
(45) Date of Patent: Mar. 16, 2004

(54) TRAFFIC SIGNAL LIGHT OF ENHANCED VISIBILITY

(76) Inventor: Elburn S. Moore, 8555 S. Lewis #130, Tulsa, OK (US) 74137

( * ) Notice: Subject to any disclaimer, the term of this patent is extended or adjusted under 35 U.S.C. 154(b) by 0 days.

(21) Appl. No.: 10/281,925

(22) Filed: Oct. 29, 2002

(51) Int. Cl.[7] ..... G08G 1/095

(52) U.S. Cl. ..... 340/907; 340/925; 340/815.65; 362/227

(58) Field of Search ..... 340/907, 908, 340/916, 925, 815.65; 362/27, 552, 227, 230, 231, 236; 116/63 R; 40/581, 541, 584, 607.15

(56) References Cited

U.S. PATENT DOCUMENTS 4,558,299 A * 12/1985 Conn ..... 362/243
4,983,952 A 1/1991 Athalye ..... 340/467
5,252,969 A 10/1993 Kishi ..... 340/908
5,327,123 A * 7/1994 Heimann et al. ..... 340/916
5,710,560 A 1/1998 Cohn ..... 340/982
5,838,260 A * 11/1998 Liu ..... 340/907
6,054,932 A * 4/2000 Gartner et al. ..... 340/815.65
6,268,805 B1 7/2001 Simon ..... 340/907

* cited by examiner

*Primary Examiner*—Daniel J. Wu
*Assistant Examiner*—Phung T Nguyen
(74) *Attorney, Agent, or Firm*—Norman Rainer

(57) ABSTRACT

A traffic signal light is caused to have improved visual perceptibility and distinctiveness by the addition of blue light sources that interact with the conventional red and green lights to alter their hues. The blue light sources have a rapidly varying intensity, producing a flickering effect. The combination of the change in hue and flickering effect causes the red and green lights to attract greater visual attention and to be more readily distinguished from other lights encountered during driving, especially during night-time driving.

10 Claims, 1 Drawing Sheet

TRAFFIC SIGNAL LIGHT OF ENHANCED VISIBILITY

BACKGROUND OF THE INVENTION

1. Field of the Invention

This invention relates to traffic signal lights of the type generally positioned at road intersections, and more particularly concerns traffic signal lights which sequentially display green, amber and red lights.

2. Description of the Prior Art

Traffic signal lights are generally comprised of an enclosure that houses green, amber and red lights. The switching mechanism for controlling the activation of the lights may be located within the enclosure or at a remote site. In communities having considerable business, industrial or other commercial activity closely adjacent streets having substantial vehicular activity there is generally a significant amount of artifical light sources, particularly in the form of advertising signage. The advertising signs often employ red-colored neon illumination because the red color is most visibly distinctive. However, the red color of neon lights can often confuse a driver who is looking at the traffic signal light, especially under nighttime conditions.

The use of flashing lights to attract greater visual perception is commonplace. However, if the flashing principle were to be employed for enhancing the visual perception of traffic lights, there would still be confusion with extraneous lights employed for roadside advertising, and with warning lights such as those employed on brake lights, turn signal indicators and police and emergency vehicles.

It is accordingly an object of the present invention to provide a traffic signal light having improved visual recognizability.

It is another object of this invention to provide a traffic signal light as in the foregoing object having improved discernability with respect to competing light sources.

It is a further object of the present invention to provide an improved traffic signal light of the aforesaid nature which can be retrofitted into existing traffic light enclosures.

It is yet another object of this invention to provide a traffic signal light of the aforesaid nature which is of simple, durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a traffic signal light comprised of green, amber and red primary lights disposed in a linear array within a protective enclosure, associated timing means for the sequential activation of said lights, and a source of electrical current for said activation, said traffic signal light further including:

a. a light of blue color adapted to interact with said primary red and green lights when said primary lights are activated, and b. flasher means for causing said blue light to have a rapidly cycling intensity, whereby c. the illumination added to said red light by said blue light causes said red light to have a visually perceived modified hue of rapidly varying intensity, and d. the illumination added to said green light by said blue light causes said green light to have a visually perceived modified hue of rapidly varying intensity.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
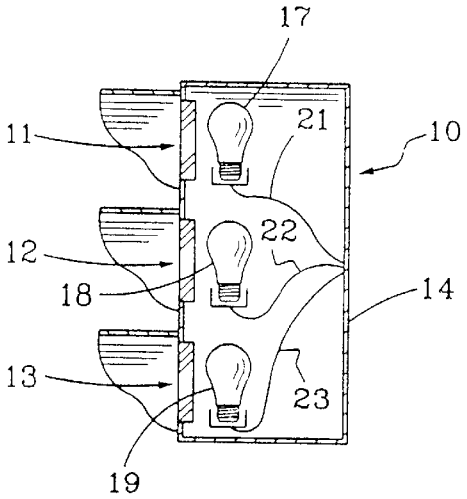
FIG. 1 is a sectional side view of an embodiment of the traffic signal light of the present invention.
Figure 2:
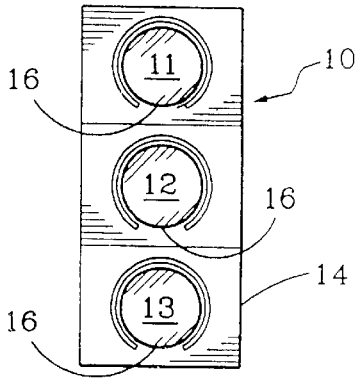
FIG. 2 is a front view thereof.
Figure 3:
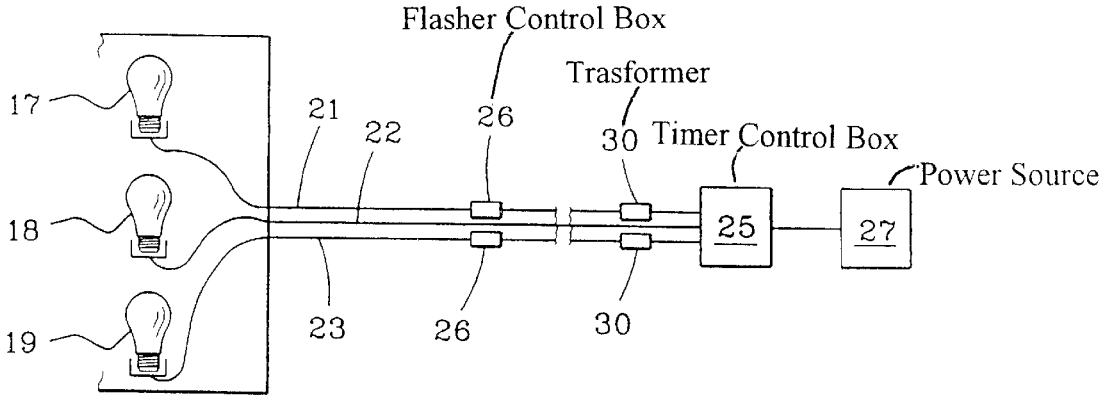
FIG. 3 is a schematic view of the control and activation system for the traffic light of FIG. 1.

Referring now to FIGS. 1–3, an embodiment of the traffic light signal 10 of the present invention is shown comprised of primary red, amber and green light assemblies 11, 12 and 13 respectively disposed in a linear array within protective enclosure 14. Each light assembly is comprised of a colored filter 16 which is a weatherproof window of said enclosure, and associated incandescent light bulbs 17, 18 and 19 for said red, amber and green light assemblies, respectively.

Said array may be vertical or horizontal. The amber light is positioned between said red and green lights. When the array is oriented in a vertical position, the top light is red, middle light amber and lowermost light green. When the array is horizontally oriented, the left light is red, middle light amber, and right light green. The enclosure is conspicuously mounted adjacent a road intersection at an elevated location such as suspended from an overhead support, or mounted atop a vertical post.

Red light assembly 11 is comprised of a red colored filter 16, and a light bulb 17 capable of producing light of a blue color.

Said blue color may be produced either by way of a colored glass which forms said bulb, or by way of a blue coating deposited upon the exterior glass portion of said bulb. Amber light assembly 12 is comprised of an amber colored filter 16, and a light bulb 18 which emits white light. Green light assembly 13 is comprised of a green colored filter 16, and a light bulb 19 which produces light of a blue color. Said colored filters may be Fresnel lenses which produce a directed beam of light.

Light bulbs 17, 18 and 19 are separately associated with electrical conductor wires 21, 22 and 23, respectively, which extend away from enclosure 14 to engagement with on/off timer control box 25. Flasher control boxes 26 are interposed within the conductive paths of wires 21 and 23 between enclosure 14 and timer control box 25, and are adapted to produce rapid cycling of electrical power at a frequency between 3 and 12 cycles per second. Such frequency produces an attention-attracting flicker effect. In one manner of operation, the flasher may operate as an on-off switch. In an alternative manner of operation, the flasher may vary the strength of the electrical current passed on to the respective blue bulb between high and low values. In such latter manner of operation, preferably achieved by way of voltage variations, not only does the intensity of the emitted light vary, but the hue of the light also varies between a true red or green at the lower intensity levels to blue-red and blue-green at the higher intensity levels. This feature augments the attention-attracting effect and the distinctiveness of the traffic signal. A power source 27 supplies operating electrical current to timer control box 25, said current then being routed through said conductor wires for the activation of said light bulbs. Power attenuating means in the form of transformers 30 may be associated with said conductor wires in order to modify the intensity of light emergent from each light assembly. In a preferred embodiment, the intensity of light emergent from said light assemblies is lower than the usual intensity of traffic signal lights.

The aforesaid components and their interaction enable commonplace traffic control signals to be retrofitted with blue light bulbs and associated flasher devices to facilitate operation by the usual timer control box. The retrofitted traffic control signal will produce a flashing red light having a very distinctive blue hue, and a flashing green light having a very distinctive blue hue. Such characteristics of the red and green lights cause the traffic signal light to have greater visibility and to be more distinguishable over extraneous interfering light sources.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A traffic signal light comprised of green, amber and red primary lights disposed in a linear array within a protective enclosure, associated timing means for the sequential activation of said lights, and a source of electrical current for said activation, said traffic signal light further including:

a. a light of blue color adapted to interact with said primary red and green lights when said primary lights are activated, and b. flasher means for causing said blue light to have a rapidly cycling intensity, whereby c. the illumination added to said red light by said blue light causes said red light to have a visually perceived modified hue of rapidly varying intensity, and d. the illumination added to said green light by said blue light causes said green light to have a visually perceived modified hue of rapidly varying intensity.

2. The signal light of claim 1 wherein each primary light is an assembly comprised of a colored filter and an associated incandescent light bulb.

3. The signal light of claim 2 wherein the light bulbs of said red and green assemblies produce light of a blue color.

4. The signal light of claim 3 wherein each colored filter serves as a weatherproof window of said enclosure.

5. The signal light of claim 4 wherein each colored filter incorporates Fresnel lens characteristics.

6. The signal light of claim 2 wherein each light bulb is associated with a separate electrical conductor communicating with said source of electrical current.

7. The signal light of claim 6 wherein said flasher means are interactive with the electrical conductors that serve said red and green assemblies.

8. The signal light of claim 1 wherein said flasher means produces a frequency of cycles of between 3 and 12 cycles per second.

9. The signal light of claim 1 wherein said flasher means functions in an on and off manner of operation.

10. The signal light of claim 1 wherein said flasher means functions in a manner to control passage of electrical current between high and low intensity levels.

* * * * *